US006721700B1

(12) United States Patent
Yin

(10) Patent No.: US 6,721,700 B1
(45) **Date of Patent: *Apr. 13, 2004**

(54) AUDIO CODING METHOD AND APPARATUS

(75) Inventor: Lin Yin, Miltapas, CA (US)

(73) Assignee: Nokia Mobile Phones Limited, Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/036,102

(22) Filed: Mar. 6, 1998

(30) Foreign Application Priority Data

Mar. 14, 1997 (FI) ..... 971108

(51) Int. Cl.[7] ..... G10L 19/02
(52) U.S. Cl. ..... 704/219; 704/230
(58) Field of Search ..... 704/219, 262, 704/220, 223, 230, 261, 221

(56) References Cited

U.S. PATENT DOCUMENTS

| | | | | |
|---|---|---|---|---|
| 4,538,234 A | | 8/1985 | Honda et al. | 364/513.5 |
| 4,939,749 A | | 7/1990 | Zurcher | 375/30 |
| 4,969,192 A | | 11/1990 | Chen et al. | 381/31 |
| 5,007,092 A | * | 4/1991 | Galand et al. | 704/220 |
| 5,089,818 A | | 2/1992 | Mahieux et al. | 341/76 |
| 5,115,240 A | * | 5/1992 | Fujiwara et al. | 704/219 |
| 5,206,884 A | | 4/1993 | Bhaskar | 375/34 |
| 5,444,816 A | | 8/1995 | Adoul et al. | 395/2.28 |
| 5,483,668 A | | 1/1996 | Malkamaki et al. | 455/33.2 |
| 5,548,680 A | * | 8/1996 | Cellario | 704/207 |
| 5,579,433 A | | 11/1996 | Jarvinen | 395/228 |
| 5,675,702 A | * | 10/1997 | Gerson et al. | 704/219 |
| 5,699,484 A | * | 12/1997 | Davis | 704/219 |
| 5,706,395 A | * | 1/1998 | Arslan et al. | 705/226 |
| 5,742,733 A | * | 4/1998 | Jarvinen | 704/220 |
| 5,778,335 A | * | 7/1998 | Ubale et al. | 704/223 |
| 5,819,212 A | * | 10/1998 | Matsumoto et al. | 704/219 |
| 5,905,970 A | * | 5/1999 | Aoyagi | 704/220 |
| 5,933,803 A | * | 8/1999 | Ojala | 704/223 |

FOREIGN PATENT DOCUMENTS

| | | |
|---|---|---|
| EP | 0 396 121 | 11/1990 |
| EP | 0 709 981 | 5/1996 |
| WO | WO 89/07866 | 8/1989 |
| WO | WO 96/19876 | 6/1996 |

OTHER PUBLICATIONS

PCT International Search Report.

UK Search Report.

"Analysis of the Self–Excited Subband Coder: A New Approach to Medium Band Speech Coding", Nayebi et al., 1988 International Conference on Acoustics, Speech, and Signal Processing, vol. 1, pp. 390–393.

French Search Report.

ISO/IEC DIS 13818–7 "Information Technology—Generic Coding of Moving Pictures and Associated Audio Information".

"Stability and Performance Analysis of Pitch Filters in Speech Coders", Ramachandran et al., IEEE Transactions on Acoustics, Speech, and Signal Processing, vol. 35, No. 7, pp. 937–946, Jul. 1987.

* cited by examiner

*Primary Examiner*—Daniel Abebe
(74) *Attorney, Agent, or Firm*—Perman & Green, LLP

(57) ABSTRACT

A method of coding an audio signal comprises receiving an audio signal x to be coded and transforming the received signal from the time to the frequency domain. A quantised audio signal $\tilde{x}$ is generated from the transformed audio signal x together with a set of long-term prediction coefficients A which can be used to predict a current time frame of the received audio signal directly from one or more previous time frames of the quantised audio signal $\tilde{x}$. A predicted audio signal $\hat{x}$ is generated using the prediction coefficients A. The predicted audio signal $\hat{x}$ is then transformed from the time to the frequency domain and the resulting frequency domain signal compared with that of the received audio signal x to generate an error signal E(k) for each of a plurality of frequency sub-bands. The error signals E(k) are then quantised to generate a set of quantised error signals $\tilde{E}(k)$ which are combined with the prediction coefficients A to generate a coded audio signal.

23 Claims, 5 Drawing Sheets

AUDIO CODING METHOD AND APPARATUS

FIELD OF THE INVENTION

The present invention relates to a method and apparatus for audio coding and to a method and apparatus for audio decoding.

BACKGROUND OF THE INVENTION

It is well known that the transmission of data in digital form provides for increased signal to noise ratios and increased information capacity along the transmission channel. There is however a continuing desire to further increase channel capacity by compressing digital signals to an ever greater extent. In relation to audio signals, two basic compression principles are conventionally applied. The first of these involves removing the statistical or deterministic redundancies in the source signal whilst the second involves suppressing or eliminating from the source signal elements with are redundant insofar as human perception is concerned. Recently, the latter principle has become predominant in high quality audio applications and typically involves the separation of an audio signal into its frequency components (sometimes called "sub-bands"), each of which is analysed and quantised with a quantisation accuracy determined to remove data irrelevancy (to the listener). The ISO (International Standards Organisation) MPEG (Moving Pictures Expert Group) audio coding standard and other audio coding standards employ and further define this principle. However, MPEG (and other standards) also employs a technique know as "adaptive prediction" to produce a further reduction in data rate.

The operation of an encoder according to the new MPEG-2 AAC standard is described in detail in the draft International standard document ISO/IEC DIS 13818-7. This new MPEG-2 standard employs backward linear prediction with 672 of 1024 frequency components. It is envisaged that the new MPEG-4 standard will have similar requirements. However, such a large number of frequency components results in a large computational overhead due to the complexity of the prediction algorithm and also requires the availability of large amounts of memory to store the calculated and intermediate coefficients. It is well known that when backward adaptive predictors of this type are used in the frequency domain, it is difficult to further reduce the computational loads and memory requirements. This is because the number of predictors is so large in the frequency domain that even a very simple adaptive algorithm still results in large computational complexity and memory requirements. Whilst it is known to avoid this problem by using forward adaptive predictors which are updated in the encoder and transmitted to the decoder, the use of forward adaptive predictors in the frequency domain inevitably results in a large amount of "side" information because the number of predictors is so large.

It is an object to the present invention to overcome or at least mitigate the disadvantages of known prediction methods.

This and other objects are achieved by coding an audio signal using error signals to remove redundancy in each of a plurality of frequency sub-bands of the audio signal and in addition generating long term prediction coefficients in the time domain which enable a current frame of the audio signal to be predicted from one or more previous frames.

SUMMARY OF THE INVENTION

According to a first aspect of the present invention there is provided a method of coding an audio signal, the method comprising the steps of:

receiving an audio signal x to be coded;

generating a quantised audio signal $\tilde{x}$ from the received audio signal x;

generating a set of long-term prediction coefficients A which can be used to predict a current time frame of the received audio signal x directly from at least one previous time frame of the quantised audio signal $\tilde{x}$;

using the prediction coefficients A to generate a predicted audio signal $\hat{x}$;

comparing the received audio signal x with the predicted audio signal $\hat{x}$ and generating an error signal E(k) for each of a plurality of frequency sub-bands;

quantising the error signals E(k) to generate a set of quantised error signals $\tilde{E}(k)$; and combining the quantised error signal $\tilde{E}(k)$ and the prediction coefficients A to generate a coded audio signal.

The present invention provides for compression of an audio signal using a forward adaptive predictor in the time domain. For each time frame of a received signal, it is only necessary to generate and transmit a single set of forward adaptive prediction coefficients for transmission to the decoder. This is in contrast to known forward adaptive prediction techniques which require the generation of a set of prediction coefficients for each frequency sub-band of each time frame. In comparison to the prediction gains obtained by the present invention, the side information of the long term predictor is negligible.

Certain embodiments of the present invention enable a reduction in computational complexity and in memory requirements. In particular, in comparison to the use of backward adaptive prediction, there is no requirement to recalculate the prediction coefficients in the decoder. Certain embodiments of the invention are also able to respond more quickly to signal changes than conventional backward adaptive predictors.

In one embodiment of the invention, the received audio signal x is transformed in frames $x_m$ from the time domain to the frequency domain to provide a set of frequency sub-band signals X(k). The predicted audio signal $\hat{x}$ is similarly transformed from the time domain to the frequency domain to generate a set of predicted frequency sub-band signals $\hat{X}(k)$ and the comparison between the received audio signal x and the predicted audio signal $\hat{x}$ is carried out in the frequency domain, comparing respective sub-band signals against each other to generate the frequency sub-band error signals E(k). The quantised audio signal $\tilde{x}$ is generated by summing the predicted signal and the quantised error signal, either in the time domain or in the frequency domain.

In an alternative embodiment of the invention, the comparison between the received audio signal x and the predicted audio signal $\hat{x}$ is carried out in the time domain to generate an error signal e also in the time domain. This error signal e is then converted from the time to the frequency domain to generate said plurality of frequency sub-band error signals E(k).

Preferably, the quantisation of the error signals is carried out according to a psycho-acoustic model.

According to a second aspect of the present invention there is provided a method of decoding a coded audio signal, the method comprising the steps of:

receiving a coded audio signal comprising a quantised error signal $\tilde{E}(k)$ for each of a plurality of frequency sub-bands of the audio signal and, for each time frame of the audio signal, a set of prediction coefficients A which can be used to predict a current time frame $x_m$ of the received audio signal directly from at least one previous time frame of a reconstructed quantised audio signal $\tilde{x}$;

generating said reconstructed quantised audio signal $\tilde{x}$ from the quantised error signals $\tilde{E}(k)$;

using the prediction coefficients A and the quantised audio signal $\tilde{x}$ to generate a predicted audio signal $\hat{x}$;

transforming the predicted audio signal $\hat{x}$ from the time domain to the frequency domain to generate a set of predicted frequency sub-band signals $\hat{X}(k)$ for combining with the quantised error signals $\tilde{E}(k)$ to generate a set of reconstructed frequency sub-band signals $\tilde{X}(k)$; and performing a frequency to time domain transform on the reconstructed frequency sub-band signals $\tilde{X}(k)$ to generate the reconstructed quantised audio signal $\tilde{x}$.

Embodiments of the above second aspect of the invention are particularly applicable where only a sub-set of all possible quantised error signals $\tilde{E}(k)$ are received, some sub-band data being transmitted directly by the transmission of audio sub-band signals X(k). The signals $\tilde{X}(k)$ and X(k) are combined appropriately prior to carrying out the frequency to time transform.

According to a third aspect of the present invention there is provided apparatus for coding an audio signal, the apparatus comprising:

an input for receiving an audio signal x to be coded;

quantisation means coupled to said input for generating from the received audio signal x a quantised audio signal $\tilde{x}$;

prediction means coupled to said quantisation means for generating a set of long-term prediction coefficients A for predicting a current time frame $x_m$ of the received audio signal x directly from at least one previous time frame of the quantised audio signal $\tilde{x}$;

generating means for generating a predicted audio signal $\hat{x}$ using the prediction coefficients A and for comparing the received audio signal x with the predicted audio signal $\hat{x}$ to generate an error signal E(k) for each of a plurality of frequency sub-bands;

quantisation means for quantising the error signals E(k) to generate a set of quantised error signals $\tilde{E}(k)$; and combining means for combining the quantised error signals $\tilde{E}(k)$ with the prediction coefficients A to generate a coded audio signal.

In one embodiment, said generating means comprises first transform means for transforming the received audio signal x from the time to the frequency domain and second transform means for transforming the predicted audio signal $\hat{x}$ from the time to the frequency domain, and comparison means arranged to compare the resulting frequency domain signals in the frequency domain.

In an alternative embodiment of the invention, the generating means is arranged to compare the received audio signal x and the predicted audio signal $\hat{x}$ in the time domain.

According to a fourth aspect of the present invention there is provided apparatus for decoding a coded audio signal x, where the coded audio signal comprises a quantised error signal $\tilde{E}(k)$ for each of a plurality of frequency sub-bands of the audio signal and a set of prediction coefficients A for each time frame of the audio signal and wherein the prediction coefficients A can be used to predict a current time frame $x_m$ of the received audio signal directly from at least one previous time frame of a reconstructed quantised audio signal $\tilde{x}$, the apparatus comprising:

an input for receiving the coded audio signal;

generating means for generating said reconstructed quantised audio signal $\tilde{x}$ from the quantised error signals $\tilde{E}(k)$; and signal processing means for generating a predicted audio signal $\hat{x}$ from the prediction coefficients A and said reconstructed audio signal $\tilde{x}$, wherein said generating means comprises first transforming means for transforming the predicted audio signal $\hat{x}$ from the time domain to the frequency domain to generate a set of predicted frequency sub-band signals $\hat{X}(k)$, combining means for combining said set of predicted frequency sub-band signals $\hat{X}(k)$ with the quantised error signals $\tilde{E}(k)$ to generate a set of reconstructed frequency sub-band signals $\tilde{X}(k)$, and second transforming means for performing a frequency to time domain transform on the reconstructed frequency sub-band signals $\tilde{X}(k)$ to generate the reconstructed quantised audio signal $\tilde{x}$.

DETAILED DESCRIPTION

Figure 1:
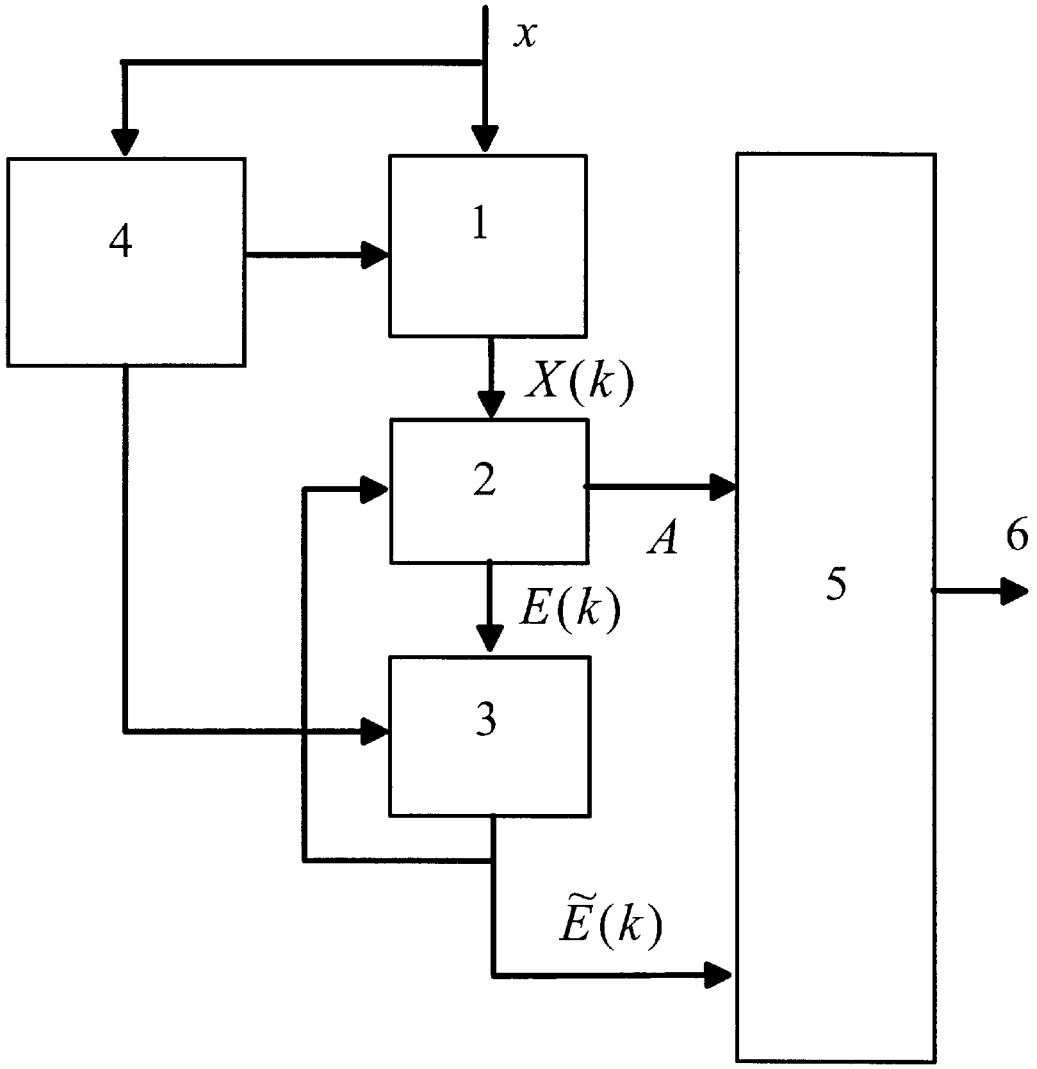
FIG. 1 shows schematically an encoder for coding a received audio signal.

There is shown in FIG. 1 a block diagram of an encoder which performs the coding function defined in general terms in the MPEG-2 AAC standard. The input to the encoder is a sampled monophasic signal x whose sample points are grouped into time frames or blocks of 2N points, i.e.

$$x_m=(x_m(0), x_m(1), \ldots, x_m(2N-1))^T \tag{1}$$

where m is the block index and T denotes transposition. The grouping of sample points is carried out by a filter bank tool 1 which also performs a modified discrete cosine transform (MDCT) on each individual frame of the audio signal to generate a set of frequency sub-band coefficients $$X_m=(X_m(0), X_m(1), \ldots, X_m(N-1))^T \tag{2}$$

The sub-bands are defined in the MPEG standard. The forward MDCT is defined by $$X_m(k) = \sum_{i=0}^{2N-1} f(i)x_m(i)\cos\left(\frac{\pi}{4N}(2i+1+N)(2k+1)\right), \quad k = 0, \ldots, N-1 \tag{3}$$

where f(i) is the analysis-synthesis window, which is a symmetric window such that its added-overlapped effect is producing a unity gain in the signal.

The frequency sub-band signals X(k) are in turn applied to a prediction tool 2 (described in more detail below) which seeks to eliminate long term redundancy in each of the sub-band signals. The result is a set of frequency sub-band error signals $$E_m(k)=(E_m(0), E_m(1), \ldots, E_m(N-1))^T \quad (4)$$

which are indicative of long term changes in respective sub-bands, and a set of forward adaptive prediction coefficients A for each frame.

The sub-band error signals E(k) are applied to a quantiser 3 which quantises each signal with a number of bits determined by a psychoacoustic model. This model is applied by a controller 4. As discussed, the psychoacoustic model is used to model the masking behaviour of the human auditory system. The quantised error signals $\tilde{E}(k)$ and the prediction coefficients A are then combined in a bit stream multiplexer 5 for transmission via a transmission channel 6.

Figure 2:
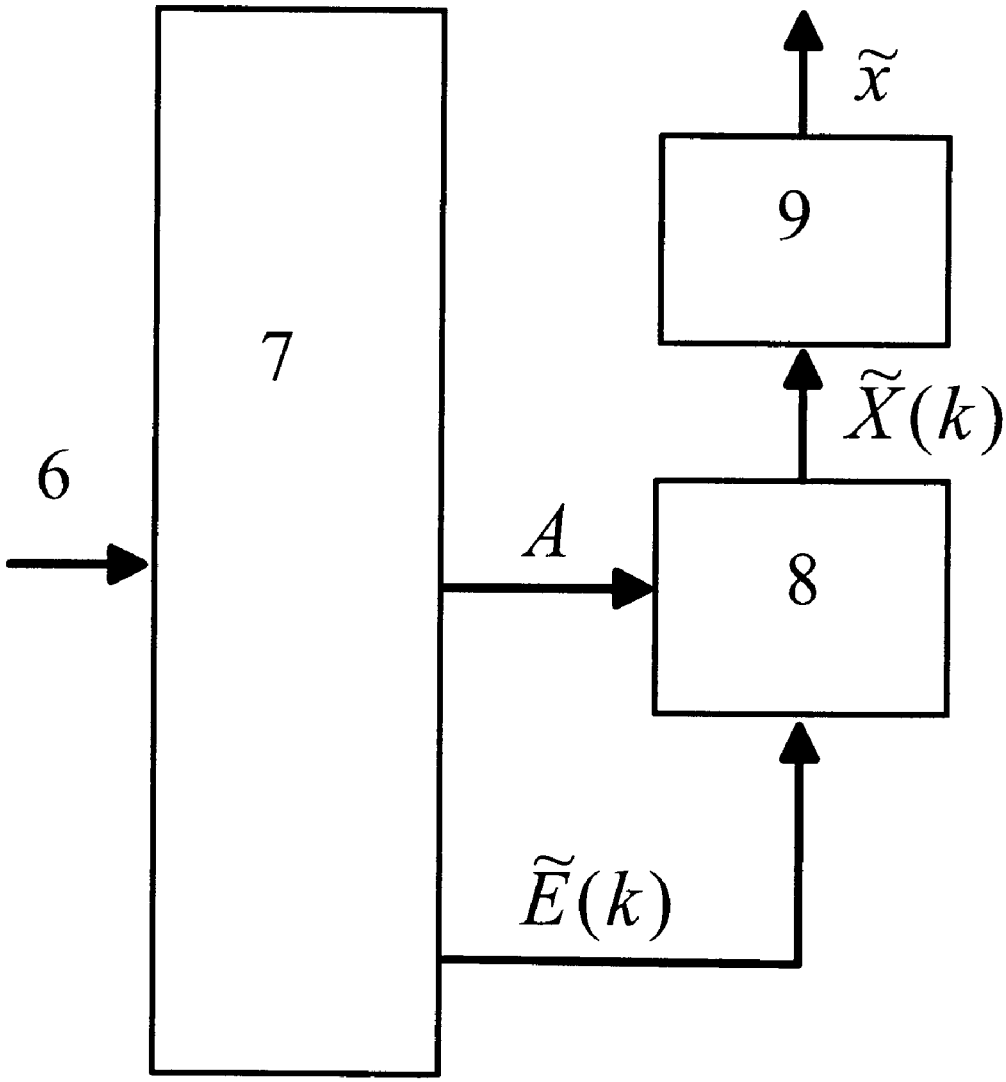
FIG. 2 shows schematically a decoder for decoding an audio signal coded with the encoder of FIG. 1.

FIG. 2 shows the general arrangement of a decoder for decoding an audio signal coded with the encoder of FIG. 1. A bit-stream demultiplexer 7 first separates the prediction coefficients A from the quantised error signals $\tilde{E}(k)$ and separates the error signals into the separate sub-band signals. The prediction coefficients A and the quantised error sub-band signals $\tilde{E}(k)$ are provided to a prediction tool 8 which reverses the prediction process carried out in the encoder, i.e. the prediction tool reinserts the redundancy extracted in the encoder, to generate reconstructed quantised sub-band signals $\tilde{X}(k)$. A filter bank tool 9 then recovers the time domain signal $\tilde{x}$, by an inverse transformation on the received version $\tilde{X}(k)$, described by $$\tilde{x}_m(i)=\tilde{u}_{m-1}(i+N)+\tilde{u}_m(i),\ i=0, \ldots, N-1 \quad (5)$$

where $\tilde{u}_k(i)$, i=0, . . . , 2N−1 are the inverse transform of $\tilde{X}$ $$\tilde{u}_m(i) = f(i)\sum_{k=0}^{N-1} \tilde{X}_m(k)\cos\left(\frac{\pi}{4N}(2i+1+N)(2k+1)\right),$$
$$i = 0, \ldots, 2N-1$$

and which approximates the original audio signal x.

Figure 3:
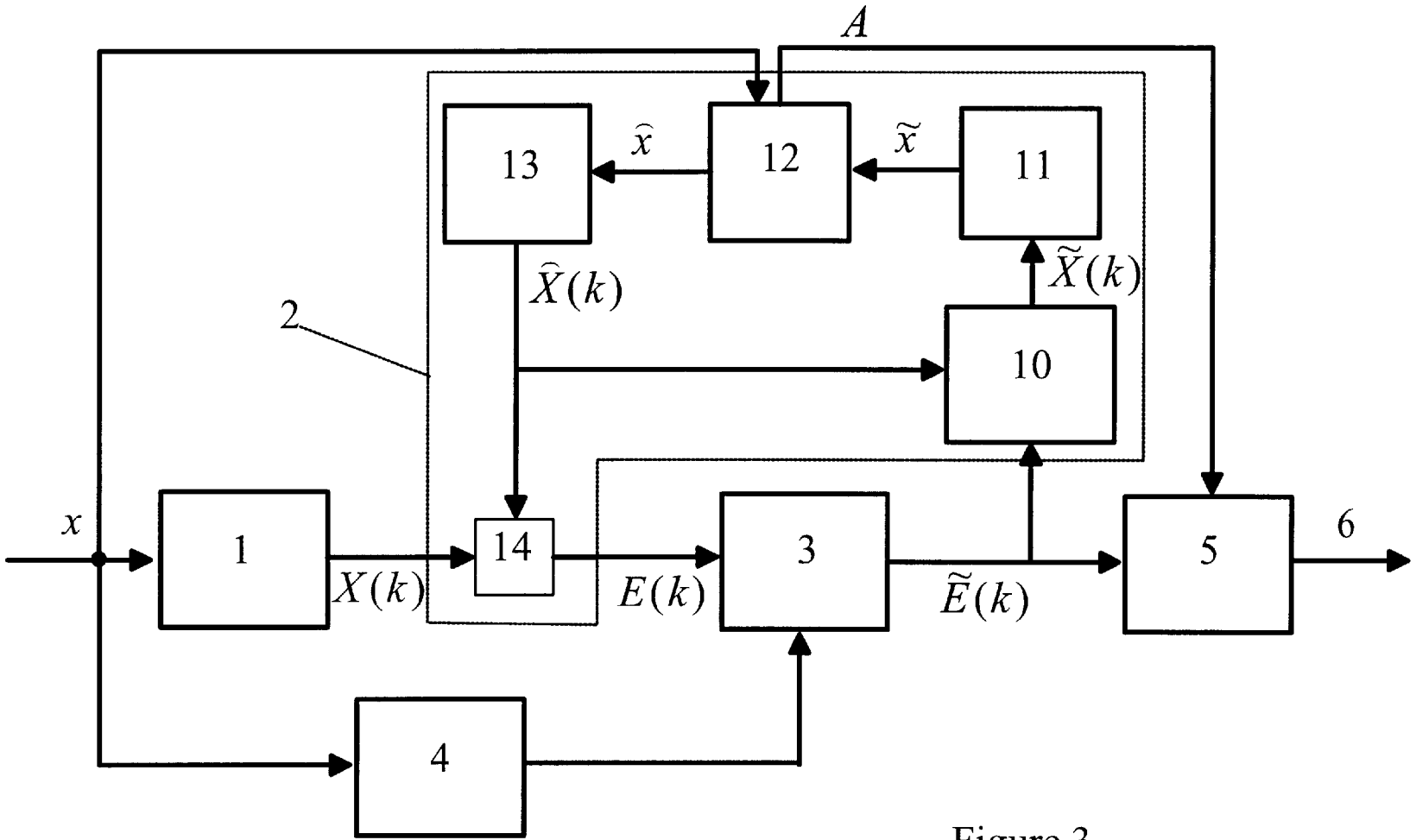
FIG. 3 shows the encoder of FIG. 1 in more detail including a predictor tool of the encoder.

FIG. 3 illustrates in more detail the prediction method of the encoder of FIG. 1. Using the quantised frequency sub-band error signals E(k), a set of quantised frequency sub-band signals $\tilde{X}(k)$ are generated by a signal processing unit 10. The signals $\tilde{X}(k)$ are applied in turn to a filter bank 11 which applies an inverse modified discrete cosine transform (IMDCT) to the signals to generate a quantised time domain signal $\tilde{x}$. The signal $\tilde{x}$ is then applied to a long term predictor tool 12 which also receives the audio input signal x. The predictor tool 12 uses a long term (LT) predictor to remove the redundancy in the audio signal present in a current frame m+1, based upon the previously quantised data. The transfer function P of this predictor is:

$$P(z) = \sum_{k=-m_1}^{m_2} b_k z^{-(\alpha+k)} \quad (5)$$

where α represents a long delay in the range 1 to 1024 samples and $b_k$ are prediction coefficients. For $m_1=m_2=0$ the predictor is one tap whilst for $m_1=m_2=1$ the predictor is three tap.

The parameters α and $b_k$ are determined by minimising the mean squared error after LT prediction over a period of 2N samples. For a one tap predictor, the LT prediction residual r(i) is given by:

$$r(i)=x(i)-b\tilde{x}(i-2N+1-\alpha) \quad (6)$$

where x is the time domain audio signal and $\tilde{x}$ is the time domain quantised signal. The mean squared residual R is given by:

$$R = \sum_{i=0}^{2N-1} r^2(i) = \sum_{i=0}^{2N-1} (x(i) - b\tilde{x}(i-2N+1-\alpha))^2 \quad (7)$$

Setting ∂R/∂b=0 yields $$b = \frac{\sum_{i=0}^{2N-1} x(i)\tilde{x}(i-2N+1-\alpha)}{\sum_{i=0}^{2N-1} (\tilde{x}(i-2N-\alpha))^2} \quad (8)$$

and substituting for b into equation (7) gives $$R = \sum_{i=0}^{2N-1} x^2(i) - \frac{\left(\sum_{i=0}^{2N-1} x(i)\tilde{x}(i-2N+1-\alpha)\right)^2}{\sum_{i=0}^{2N-1} (\tilde{x}(n-2N+1-\alpha))^2} \quad (9)$$

Minimizing R means maximizing the second term in the right-hand side of equation (9). This term is computed for all possible values of α over its specified range, and the value of α which maximizes this term is chosen. The energy in the denominator of equation (9), identified as Ω, can be easily updated from delay (α−1) to α instead of recomputing it afresh using:

$$\Omega_\alpha=\Omega_{\alpha-1}+\tilde{x}^2(-\alpha)-\tilde{x}^2(-\alpha+N) \quad (10)$$

If a one-tap LT predictor is used, then equation (8) is used to compute the prediction coefficient $b_j$. For a j-tap predictor, the LT prediction delay α is first determined by maximizing the second term of Equation (9) and then a set of j×j equations is solved to compute the j prediction coefficients.

The LT prediction parameters A are the delay α and prediction coefficient $b_j$. The delay is quantized with 9 to 11 bits depending on the range used. Most commonly 10 bits are utilized, with 1024 possible values in the range 1 to 1024. To reduce the number of bits, the LT prediction delays can be delta coded in even frames with 5 bits. Experiments show that it is sufficient to quantize the gain with 3 to 6 bits. Due to the nonuniform distribution of the gain, nonuniform quantization has to be used.

In the method described above, the stability of the LT synthesis filter 1/P(z) is not always guaranteed. For a one-tap predictor, the stability condition is $|b|\leqq 1$. Therefore, the stabilization can be easily carried out by setting |b|=1 whenever |b|>1. For a 3-tap predictor, another stabilization procedure can be used such as is described in R. P. Ramachandran and P. Kabal, "Stability and performance analysis of pitch filters in speech coders," IEEE Trans. ASSP, vol. 35, no. 7, pp.937–946, July 1987. However, the instability of the LT synthesis filter is not that harmful to the quality of the reconstructed signal. The unstable filter will persist for a few frames (increasing the energy), but eventually periods of stability are encountered so that the output does not continue to increase with time.

After the LT predictor coefficients are determined, the predicted signal for the (m+1)th frame can be determined:

$$\hat{x}(i) = \sum_{j=-m_1}^{m_2} b_j \tilde{x}(i - 2N + 1 - j - \alpha), \quad (11)$$

$$i = mN + 1, mN + 2, \ldots, (m+1)N$$

The predicted time domain signal $\hat{x}$ is then applied to a filter bank 13 which applies a MDCT to the signal to generate predicted spectral coefficients $\hat{X}_{m+1}(k)$ for the (m+1)th frame. The predicted spectral coefficients $\hat{X}(k)$ are then subtracted from the spectral coefficients X(k) at a subtractor 14.

In order to guarantee that prediction is only used if it results in a coding gain, an appropriate predictor control is required and a small amount of predictor control information has to be transmitted to the decoder. This function is carried out in the subtractor 14. The predictor control scheme is the same as for the backward adaptive predictor control scheme which has been used in MPEG-2 Advanced Audio Coding (AAC). The predictor control information for each frame, which is transmitted as side information, is determined in two steps. Firstly, for each scalefactor band it is determined whether or not prediction leads to a coding gain and if yes, the predictor_used bit for that scalefactor band is set to one. After this has been done for all scalefactor bands, it is determined whether the overall coding gain by prediction in this frame compensates at least the additional bit need for the predictor side information. If yes, the predictor_data_present bit is set to 1 and the complete side information including that needed for predictor reset is transmitted and the prediction error value is fed to the quantizer. Otherwise, the predictor_data_present bit is set to 0 and the prediction_used bits are all reset to zero and are not transmitted. In this case, the spectral component value is fed to the quantizer 3. As described above, the predictor control first operates on all predictors of one scalefactor band and is then followed by a second step over all scalefactor bands.

It will be apparent that the aim of LT prediction is to achieve the largest overall prediction gain. Let $G_l$ denote the prediction gain in the lth frequency sub-band. The overall prediction gain in a given frame can be calculated as follows:

$$G = \sum_{l=1 \,\&\, (G_l > 0)}^{N_s} G_l \quad (12)$$

If the gain compensates the additional bit need for the predictor side information, i.e., G>T(dB), the complete side information is transmitted and the predictors which produces positive gains are switched on. Otherwise, the predictors are not used.

The LP parameters obtained by the method set out above are not directly related to maximising the gain. However, by calculating the gain for each block and for each delay within the selected range (1 to 1024 in this example), and by selecting that delay which produces the largest overall prediction gain, the prediction process is optimised. The selected delay $\alpha$ and the corresponding coefficients b are transmitted as side information with the quantised error sub-band signals. Whilst the computational complexity is increased at the encoder, no increase in complexity results at the decoder.

Figure 4:
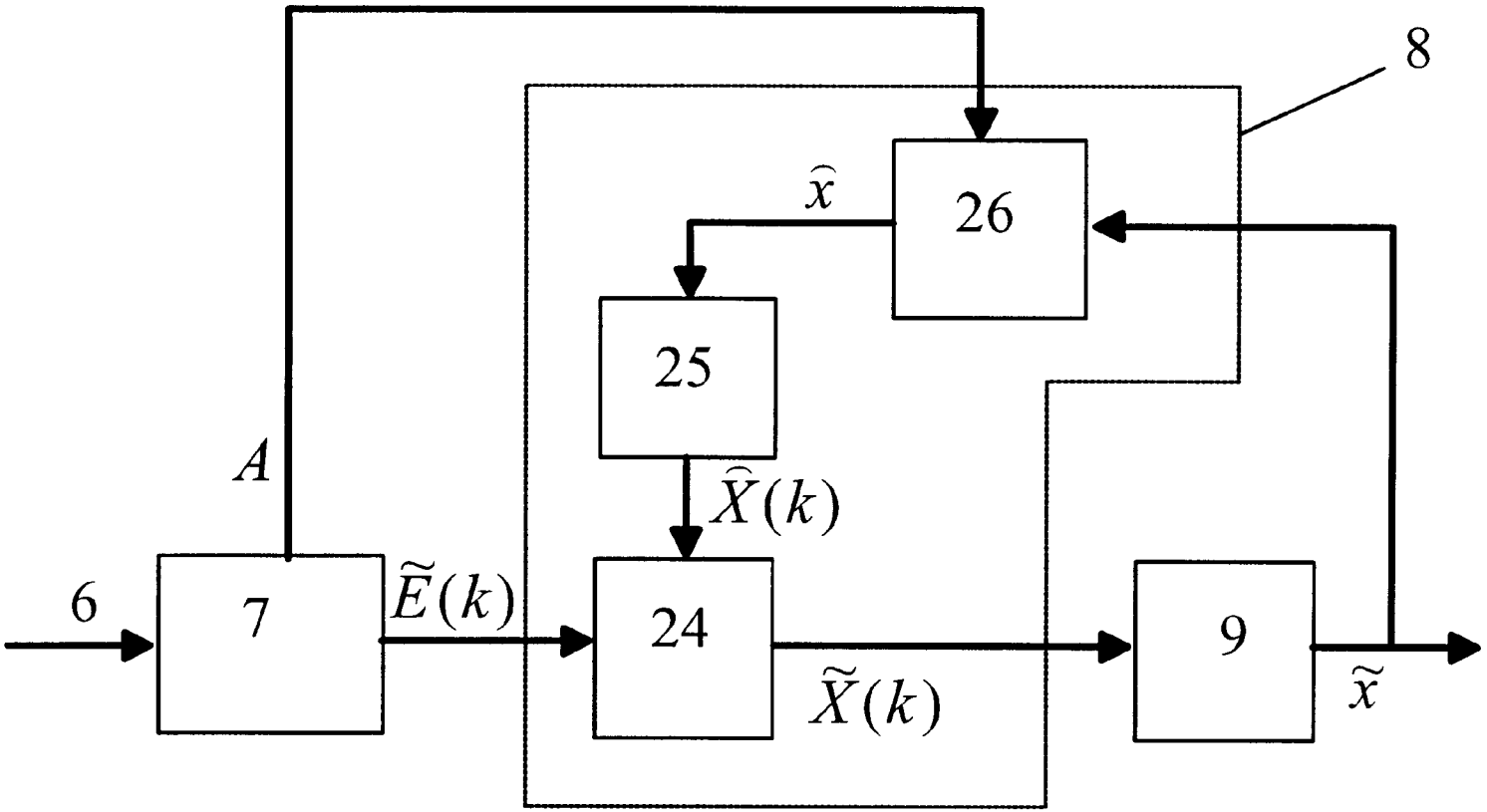
FIG. 4 shows the decoder of FIG. 2 in more detail including a predictor tool of the decoder.

FIG. 4 shows in more detail the decoder of FIG. 2. The coded audio signal is received from the transmission channel 6 by the bitstream demultiplexer 7 as described above. The bitstream demultiplexer 7 separates the prediction coefficients A and the quantised error signals $\tilde{E}(k)$ and provides these to the prediction tool 8. This tool comprises a combiner 24 which combines the quantised error signals $\tilde{E}(k)$ and a predicted audio signal in the frequency domain $\hat{X}(k)$ to generate a reconstructed audio signal $\tilde{X}(k)$ also in the frequency domain. The filter bank 9 converts the reconstructed signal $\tilde{X}(k)$ from the frequency domain to the time domain to generate a reconstructed time domain audio signal $\tilde{x}$. This signal is in turn fed-back to a long term prediction tool which also receives the prediction coefficients A. The long term prediction tool 26 generates a predicted current time frame from previous reconstructed time frames using the prediction coefficients for the current frame. A filter bank 25 transforms the predicted signal $\hat{x}$.

It will be appreciated the predictor control information transmitted from the encoder may be used at the decoder to control the decoding operation. In particular, the predictor_used bits may be used in the combiner 24 to determine whether or not prediction has been employed in any given frequency band.

Figure 5:
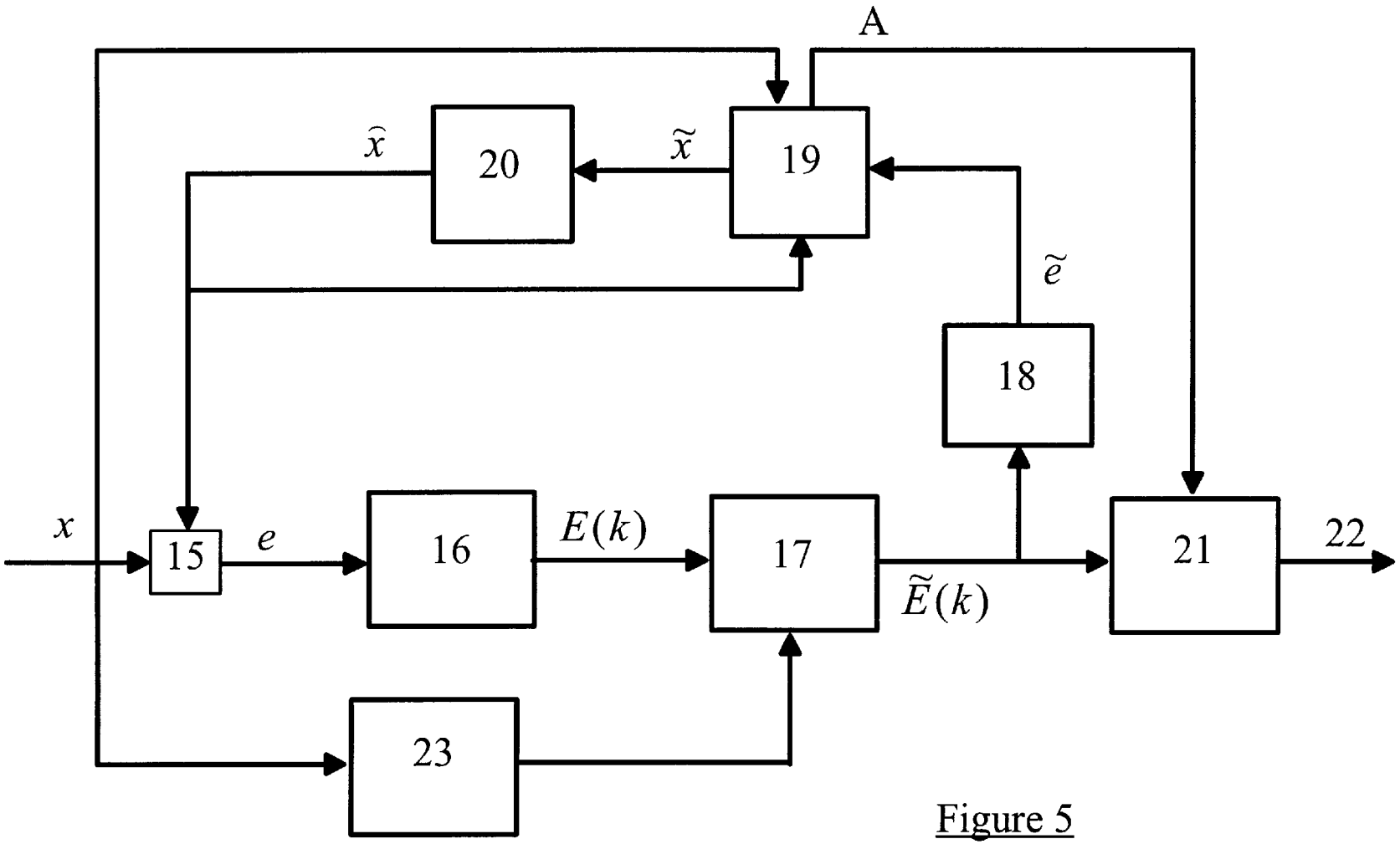
FIG. 5 shows in detail a modification to the encoder of FIG. 1 and which employs an alternative prediction tool.

There is shown in FIG. 5 an alternative implementation of the audio signal encoder of FIG. 1 in which an audio signal x to be coded is compared with the predicted signal $\hat{x}$ in the time domain by a comparator 15 to generate an error signal e also in the time domain. A filter bank tool 16 then transforms the error signal from the time domain to the frequency domain to generate a set of frequency sub-band error signals E(k). These signals are then quantised by a quantiser 17 to generate a set of quantised error signals $\tilde{E}(k)$.

A second filter bank 18 is then used to convert the quantised error signals $\tilde{E}(k)$ back into the time domain resulting in a signal $\tilde{e}$. This time domain quantised error signal $\tilde{e}$ is then combined at a signal processing unit 19 with the predicted time domain audio signal $\hat{x}$ to generate a quantised audio signal $\tilde{x}$. A prediction tool 20 performs the same function as the tool 12 of the encoder of FIG. 3, generating the predicted audio signal $\hat{x}$ and the prediction coefficients A. The prediction coefficients and the quantised error signals are combined at a bit stream multiplexer 21 for transmission over the transmission channel 22. As described above, the error signals are quantised in accordance with a psychoacoustical model by a controller 23.

The audio coding algorithms described above allow the compression of audio signals at low bit rates. The technique is based on long term (LT) prediction. Compared to the known backward adaptive prediction techniques, the techniques described here deliver higher prediction gains for single instrument music signals and speech signals whilst requiring only low computational complexity.

What is claimed is:

1. A method of coding an audio signal, the method comprising the steps of:

receiving an audio signal x to be coded;

generating frequency sub-bands from a time frame of the received audio signal;

generating a quantised audio signal $\tilde{x}$ from the received audio signal x;

generating a set of long-term prediction coefficients A;

predicting a current time frame of the received audio signal by using the same long-term prediction coefficients A for a plurality of sub-bands of a time frame directly from at least one previous time frame of the quantised audio signal $\tilde{x}$;

using the set of long-term prediction coefficients A to generate a predicted audio signal $\hat{x}$ of the quantised audio signal $\tilde{x}$;

comparing the received audio signal x with the predicted audio signal $\hat{x}$ and generating an error signal E(k) for each of a plurality of frequency sub-bands;

quantising the error signals E(k) to generate a set of quantised error signals $\tilde{E}(k)$; and combining the quantised error signals $\tilde{E}(k)$ and the prediction coefficients A to generate a coded audio signal.

2. A method according to claim 1 and comprising transforming the received audio signal x in frames $x_m$ from the time domain to the frequency domain to provide a set of frequency sub-band signals X(k) and transforming the predicted audio signal $\hat{x}$ from the time domain to the frequency domain to generate a set of predicted frequency sub-band signals $\hat{X}(k)$, wherein the comparison between the received audio signal x and the predicted audio signal $\hat{x}$ is carried out in the frequency domain, comparing respective sub-band signals against each other to generate the frequency sub-band error signals E(k).

3. A method according to claim 1 and comprising carrying out the comparison between the received audio signal x and the predicted audio signal $\hat{x}$ in the time domain to generate an error signal e also in the time domain and converting the error signal e from the time to the frequency domain to generate said plurality of frequency sub-band error signals E(k).

4. A method according to claim 1, wherein the same long-term prediction coefficients A form the set of long-term prediction coefficients A.

5. A method according to claim 4, wherein the set of long term prediction coefficients A is a single set of long-term prediction coefficients.

6. A method according to claim 1, further comprising:

computing a coding gain for a plurality of scalefactor bands of said frequency sub-bands; and predicting the frequency sub-band of each scalefactor band if the prediction leads to a coding gain.

7. A method according to claim 6, further comprising:

computing an overall coding gain for all the scalefactor bands together for each time frame; and for each time frame, deciding based on the overall coding gain whether to predict the time frame.

8. A method of decoding a coded audio signal, the method comprising the steps of:

receiving a coded audio signal comprising a quantised error signal $\tilde{E}(k)$ for each of a plurality of frequency sub-bands of the audio signal and, for each time frame of the audio signal, a set of prediction coefficients A, which same prediction coefficients can be used to predict the plurality of frequency sub-bands of a current time frame $x_m$ of the received audio signal directly from at least one previous time frame of a reconstructed quantised audio signal $\tilde{x}$;

generating said reconstructed quantised audio signal $\tilde{x}$ from the quantised error signals $\tilde{E}(k)$;

using the prediction coefficients A and the quantised audio signal $\tilde{x}$ to generate a predicted audio signal $\hat{x}$;

transforming the predicted audio signal $\tilde{x}$ from the time domain to the frequency domain to generate a set of predicted frequency sub-band signals $\tilde{X}(k)$ for combining with the quantised error signals $\tilde{E}(k)$ to generate a set of reconstructed frequency sub-band $\tilde{X}(k)$; and performing a frequency to time domain transform on the reconstructed frequency sub-band signals $\tilde{X}(k)$ to generate the reconstructed quantised audio signal $\tilde{x}$.

9. A method according to claim 8, wherein the same long-term prediction coefficients A form the set of long-term prediction coefficients A.

10. A method according to claim 9, wherein the set of long term prediction coefficients A is a single set of long-term prediction coefficients.

11. Apparatus for coding an audio signal, the apparatus comprising:

an input for receiving an audio signal x to be coded;

first generating means for generating frequency sub-bands from a time frame of the received audio signal;

processing means coupled to said input for generating from the received audio signal x a quantised audio signal $\tilde{x}$;

prediction means coupled to said processing means for generating a set of long-term prediction coefficients A to be used for each of the sub-bands of a time frame for predicting a current time frame $x_m$, of the received audio signal x directly from at least one previous time frame of the quantised audio signal $\tilde{x}$;

second generating means for generating a predicted audio signal $\hat{x}$ by using the same set of long-term prediction coefficients A and the quantised audio signal $\tilde{x}$ and for comparing the received audio signal x with the predicted audio signal $\hat{x}$ to generate an error signal E(k) for each of a plurality of frequency sub-bands;

quantisation means for quantising the error signals E(k) to generate a set of quantised signals E(k); and combining means for combining the quantised error signals $\tilde{E}(k)$ with the prediction coefficients A to generate a coded audio signal.

12. Apparatus according to claim 11, wherein said second generating means comprises first transform means for transforming the received audio signal x from the time to the frequency domain and the second transform means for transforming the predicted audio signal $\hat{x}$ from the time to the frequency domain, and comparison means arranged to compare the resulting frequency domain signals in the frequency domain.

13. Apparatus according to claim 11, wherein the second generating means is arranged to compare the received audio signal x and the predicted audio signal $\hat{x}$ in the time domain.

14. Apparatus for decoding a coded audio signal x, where the coded audio signal comprises a quantised error signal E(k) for each of a plurality of frequency sub-bands of the audio signal and a common set of prediction coefficients A to be used for each of the frequency sub-bands of a time frame of the audio signal and wherein the prediction coefficients A can be used to predict a current time frame $x_m$ of the received audio signal directly from at least one previous time frame of a reconstructed quantised audio signal $\tilde{x}$, the apparatus comprising:

an input for receiving the coded audio signal;

generating means for generating said reconstructed quantised audio signal $\tilde{x}$ from the quantised error signals $\tilde{E}(k)$; and signal processing means for generating a predicted audio signal $\hat{x}$ from the prediction coefficients A and said reconstructed audio signal $\tilde{x}$ for each of a plurality of predicted frequency sub-bands of the audio signal;

wherein said generating means comprises first transforming means for transforming the predicted audio signal $\hat{x}$ from the time domain to the frequency domain to generate a set of predicted frequency sub-band signals $\hat{X}(k)$, combining means for combining said set of predicted frequency sub-band signals $\hat{X}(k)$ with the quantised error signals $\tilde{E}(k)$ to generate a set of reconstructed frequency sub-band signals $\tilde{X}(k)$, and second transforming means for performing a frequency to time domain transform on the reconstructed frequency sub-band signals $\tilde{X}(k)$ to generate the reconstructed quantised audio signal $\tilde{x}$.

15. An apparatus according to claim 14, wherein said combining means combines said set of predicted frequency sub-band signals $\hat{X}(k)$ with the quantised error signals $\tilde{E}(k)$ only for frequency sub-bands where prediction has been employed.

16. A method of decoding a coded audio signal, the method comprising the steps of:

receiving a coded audio signal comprising a quantised error signal $\tilde{E}(k)$ for each of a plurality of frequency sub-bands of the audio signal, predictor control information for each time frame of the audio signal for determining frequency bands of the audio signal which have been predicted and, for each time frame of the audio signal, a set of prediction coefficients A, which same prediction coefficients can be used to predict the plurality of frequency sub-bands of a current time frame $x_m$ of the received audio signal directly from at least one previous time frame of a reconstructed quantised audio signal $\tilde{x}$;

generating said reconstructed quantised audio signal $\tilde{x}$ from the quantised error signals $\tilde{E}(k)$, using the prediction coefficients A and the quantised audio signal $\tilde{x}$ to generate a predicted audio signal $\hat{x}$;

transforming the predicted audio signal $\tilde{x}$ from the time domain to the frequency domain to generate a set of predicted frequency sub-band signals $\hat{X}(k)$ for combining with the quantised error signals $\tilde{E}(k)$ to generate a set of reconstructed frequency sub-band signals $\tilde{X}(k)$; and performing a frequency to time domain transform on the reconstructed frequency sub-band signals $\tilde{X}(k)$ to generate the reconstructed quantised audio signal $\tilde{x}$.

17. Method for decoding a coded audio signal forming consecutive time frames, comprising the following steps in the frequency domain:

receiving a coded audio signal of a certain time frame, the coded audio signal including a plurality of quantised frequency sub-band error signals $\tilde{E}(k)$, a set of prediction coefficients A, and predictor control information;

using the predictor control information to determine those frequency bands for which prediction has been employed and then for those frequency bands performing the following steps:

predicting a plurality of predicted frequency sub-band signals $\hat{X}(k)$ of the certain time frame using a previously decoded time domain audio signal;

combining the predicted frequency sub-band signals $\hat{X}(k)$ of the certain time frame with the quantised frequency sub-band error signals $\tilde{E}(k)$ in order to generate a plurality of reconstructed audio signal sub-band signals $\tilde{X}(k)$;

transforming the reconstructed audio signal frequency sub-band signals $\tilde{X}(k)$ to the time domain for generating a quantised reconstructed audio signal $\tilde{x}$; and further in the time domain:

predicting a predicted audio signal $\hat{x}$ using the reconstructed quantised audio signal $\tilde{x}$ and the same prediction coefficients A for each predicted frequency sub-band of the audio signal; and transforming the predicted audio signal $\hat{x}$ into the frequency domain for said predicting of the predicted frequency sub-band signals $\tilde{X}(k)$.

18. A method according to claim 17, wherein said predicting of a plurality of predicted frequency sub-band signals $\hat{X}(k)$ of the certain time frame is performed using a section of previously generated quantised reconstructed time domain audio signal $\tilde{x}$.

19. A method according to claim 17, further comprising a step of combining the predicted frequency sub-band signals $\hat{X}(k)$ of the certain time frame with the quantised frequency sub-band error signals $\tilde{E}(k)$ in order to generate a plurality of reconstructed audio sub-band signals $\tilde{X}(k)$ only for predicted frequency sub-bands of the certain time frame.

20. A method of coding an audio signal, the method comprising the steps of:

receiving an audio signal x to be coded;

generating frequency sub-bands from each of a sequence of time frames of the received audio signal;

generating a quantised audio signal $\tilde{x}$ from the received audio signal x;

generating a set of long-term prediction coefficients A;

predicting a current time frame of the received audio signal by using the same set of long-term prediction coefficients A for each of the sub-bands of the time frame directly from at least one previous time frame of the quantised audio signal $\tilde{x}$ to obtain a predicted audio signal $\hat{x}$ of the quantised audio signal $\tilde{x}$;

comparing the received audio signal x with the predicted audio signal $\hat{x}$ and generating an error signal E(k) for each of a plurality of frequency sub-bands;

quantising the error signal E(k) to generate a set of quantised error signal $\tilde{E}(k)$ using a psychoacoustic model;

prior to said comparing step, transforming each of the received audio signal and the predicted audio signal to a set of frequency sub-band signals for performing the comparing step in the frequency domain;

employing data from the quantising step in the predicting step to obtain the predicted audio signal; and combining the quantised error signal $\tilde{E}(k)$ and the prediction coefficients A to generate a coded audio signal.

21. A method of coding an audio signal, the method comprising the steps of:

receiving an audio signal x to be coded;

generating frequency sub-bands from a time frame of the received audio signal;

generating a quantised audio signal from the received audio signal x;

generating a set of long-term prediction coefficients A;

predicting a current time frame of the received audio signal by using the same long-term prediction coefficients A for a plurality of sub-bands of a time frame directly from at least one previous time frame of the quantised audio signal, wherein said predicting step is accomplished by minimizing a mean squared error between the input time domain audio signal and the time domain quantised signal;

comparing the received audio signal x with the predicted audio signal and generating error signals corresponding the plurality of frequency sub-bands;

quantising the error signals to generate a set of quantised error signal components; and combining the quantised error signal components and the prediction coefficients A to generate a coded audio signal.

22. A method according to claim 21 wherein said quantising step is based on a psychoacoustic model.

23. A method according to claim 21 wherein said comparing step is accomplished in the frequency domain.

* * * * *